US007097069B2

(12) United States Patent
Cavanagh

(10) Patent No.: US 7,097,069 B2
(45) Date of Patent: Aug. 29, 2006

(54) VENDABLE PRIZE DELIVERY MECHANISM FOR LOCAL DISPENSING OF PROMOTIONAL ITEMS

(75) Inventor: John F. Cavanagh, Gainesville, GA (US)

(73) Assignee: Cavanagh Group International, Inc., Alpharetta, GA (US)

( * ) Notice: Subject to any disclaimer, the term of this patent is extended or adjusted under 35 U.S.C. 154(b) by 196 days.

(21) Appl. No.: 10/622,366

(22) Filed: Jul. 17, 2003

(65) Prior Publication Data

US 2005/0026533 A1 Feb. 3, 2005

Related U.S. Application Data

(60) Provisional application No. 60/396,913, filed on Jul. 17, 2002.

(51) Int. Cl.
*B65G 59/00* (2006.01)

(52) U.S. Cl. ..... 221/312 R; 221/312 C; 206/217; 206/457; 206/813

(58) Field of Classification Search ..... 221/312 C, 221/312 R; 206/457, 831, 217, 813; 220/500, 220/4.21

See application file for complete search history.

(56) References Cited

U.S. PATENT DOCUMENTS

| | | | | |
|---|---|---|---|---|
| 1,863,001 | A | 6/1932 | Barok et al. | |
| 2,614,673 | A | 10/1952 | Obodzinski | |
| 2,664,227 | A | 12/1953 | Probasco | |
| 2,772,811 | A | 12/1956 | Schaef | |
| 2,990,975 | A | 7/1961 | Sereno | |
| 3,085,712 | A | 4/1963 | Skumawitz | |
| 3,286,831 | A | 11/1966 | Giberstein | |
| 3,354,576 | A | 11/1967 | Gralnick | |
| 3,374,882 | A | 3/1968 | Amaliksen | |
| 3,747,746 | A | 7/1973 | Newman et al. | |
| 3,948,416 | A | 4/1976 | Housman | |
| 4,347,952 | A | 9/1982 | Bookout | |
| 4,702,392 | A | 10/1987 | Rachman | |
| 4,911,320 | A * | 3/1990 | Howes | 220/500 |
| 5,056,659 | A | 10/1991 | Howes et al. | |
| 5,069,645 | A * | 12/1991 | Dworman et al. | 446/8 |
| 5,445,287 | A | 8/1995 | Center et al. | |
| 5,505,332 | A | 4/1996 | Vogelpohl et al. | |
| 5,593,029 | A | 1/1997 | Both | |
| 5,692,606 | A | 12/1997 | Elmaleh | |
| 5,728,415 | A | 3/1998 | Troska | |
| 5,813,538 | A | 9/1998 | Kaufman | |
| 5,924,596 | A | 7/1999 | Kaufman | |
| 6,149,955 | A * | 11/2000 | Wilson | 426/112 |
| 6,247,612 | B1 * | 6/2001 | Kaufman | 221/312 C |

* cited by examiner

*Primary Examiner*—David H Bollinger
(74) *Attorney, Agent, or Firm*—Morris Manning & Martin LLP

(57) ABSTRACT

A vendable prize delivery mechanism contains a premium that is to be delivered via a vending machine. The vendable prize delivery mechanism has a currency slot to allow for the insertion of differing local currencies in the amount that the local vending machines require in the country in which the promotion is being done. The vendable prize delivery mechanism has a size and shape of a primary product container that is customarily delivered to a consumer by a vending machine. The vendable prize delivery mechanism has an opening to an interior region for insertion of the premium and a removable bottom or snap-apart capability to allow the consumer to access premium.

46 Claims, 9 Drawing Sheets

102

VENDABLE PRIZE DELIVERY MECHANISM FOR LOCAL DISPENSING OF PROMOTIONAL ITEMS

CROSS REFERENCE TO RELATED APPLICATIONS

This Application claims priority benefit under 35 U.S.C. 119(e) to U.S. Provisional Application Ser. No. 60/396,913 filed on Jul. 17, 2002 titled "Vendable Prize Delivery Article," which is hereby incorporated by reference in the entirety and made part hereof.

FIELD OF THE INVENTION

This invention relates to vendable prizes, and more particularly to the assembly method and articles of manufacture for localized dispensing of promotional items.

BACKGROUND OF THE INVENTION

Vending machines have been used by large consumer product companies to dispense their goods ("primary products") for years. Vending machines have also been used as a means to dispense premiums or promotional items in an attempt to increase sales of those primary products. These vending programs contain a promotional product that is delivered to the consumer instead of the primary product that was first intended to purchase. These vending programs require the money initially inserted by the consumer into the machine to be returned in substantially the same form and amount inserted so the consumer can complete their original intended purchase. Further, for purposes of these programs, these companies have desired to maintain their brand awareness by utilizing containers that are indistinguishable to those used to vend their primary products. This has required extensive research and testing to comply with the detailed size, weight and rigidity specifications of various manufacturers of vending machines in order to ensure that the assembled prize delivery mechanism meets the standards used by the greatest number of machines in the field as possible.

Historically, the approach to these challenges has involved a labor intensive, cumbersome process which allowed for the manual insertion of currency and the premium or promotional items into the same identical package that typically vends the primary products of these consumer products companies, with some necessary modifications to address the detailed size, weight and rigidity specifications of the various manufacturers of vending machines. For example, the process to execute a vending promotion that gives away free premium or promotional items with purchase (with the goal of increasing volume of beverage sales) would typically encompass the following:

Empty containers which would otherwise be used to vend the company's primary products would need to be sourced and delivered locally in the country in which the promotion is being done;

The desired premium or promotional products would need to be sourced and delivered, most often from a different country of manufacture where lower cost labor could be used since the intent was to give these items away free of charge;

The empty containers would be sliced open manually to allow for insertion of the desired premium or promotional products;

The desired premium or promotional products had to be inserted, most often first into a cardboard sleeve which provided for enough rigidity in the assembled container to support beverages to be stacked above the assembled container when placed in a channel in a vending machine;

The desired premium or promotional products had to be of constructed of a size and/or density, and possess the characteristics that would readily lend itself to insertion in the aforementioned sleeve;

The desired premium or promotional products had to be of such a weight that would readily lend itself to vending without substantial modifications being made to the empty containers and sleeves otherwise used to vend the company's primary products;

Currency of the local country had to be sorted in the country where the promotion was being done in the correct denomination and inserted to the empty container along with the premium or promotional product in the above referenced sleeve, in an amount which covers the cost of the primary product which the recipient originally intended to purchase in the local market;

The containers needed to be taped closed manually;

A label, most often similar in design to the company's primary product labels, would be affixed utilizing local labor in the country where the promotion was being done to the container which explained to the recipient that they had won a free premium or promotional item along with enough currency to purchase the original desired product;

The completed assembly would need to be shrink-wrapped utilizing local labor in the country where the promotion was being done to both protect the product from any beverage leakage in the vending channels and provide a level of security regarding the currency that had been inserted.

The local market adaptability of these programs has otherwise been restricted as it has been difficult to change the amount or type of currency needed to purchase the primary products to that dictated by the local currency or cost of the company's primary products. For example, not all local markets of consumer product companies in the business of vending 12 oz beverages are priced the same. Further, the premium and promotional programs that are to be executed may not have the same appeal in all local markets.

The high cost of the assembled premium or promotional item has also limited the amount of free promotional or premium items that could be given away to the recipients, thereby limiting the marketing impact on sales of the company's primary products. These cost factors were driven primarily from the need to utilize local labor at third party fulfillment operations as well as the disparate freight costs associated with sourcing the empty containers, sleeves, premiums (typically from a different country of manufacture), currency, labels and shipping containers. The finished appearance of the vessel containing the premium or promotional items has also been compromised by whatever customization was necessary to meet the detailed size, weight and rigidity specifications of the various manufacturers of vending machines, which negatively impacts brand awareness and the ability of the recipient to visualize the premium or promotional item won.

What is desired is an assembly method and mechanism that can deliver promotional or premium items at a significantly reduced cost, and which allows for the flexibility to adapt to the needs of the local market currencies and trends. This mechanism must allow for the insertion of local currency of the desired denomination and amounts necessary to allow the recipient to purchase the primary product originally desired. Further, the mechanism should be constructed of a transparent substrate that allows for the premium or promotional item to be displayed in a professional manner in substantially an identical replica of the container otherwise used by the consumer product companies for vending their primary products, yet complies with the various size, weight and rigidity specifications of the various manufacturers of vending machines.

SUMMARY OF THE INVENTION

The present invention employs a coin slot that allows for the manufacturing, assembly, labeling and sealing of the vendable prize delivery mechanism in a central location ("country of manufacture") utilizing low cost labor, thereby enabling for later insertion of currency in the local denominations and amounts where the promotion is to be done. Utilizing the coin slot, one can manufacture the vendable prize delivery mechanism in one location and insert currencies later in the local markets where the promotion is being done. Additionally, by inserting the premium into the vendable prize delivery mechanism in the country of manufacture, both can be shipped on the same freight bill to the local markets where the promotion is being done.

The vendable prize delivery mechanism has a currency slot to allow for the insertion of differing local currencies in the amount that the local vending machines require. After insertion of the currency, material may be used to cover the currency slot to minimize the occurrence of the currency being shaken out of the currency slot before being vended to a consumer.

The vendable prize delivery mechanism contains a premium that is to be delivered via a vending machine. The vendable prize delivery mechanism has a size and shape of a primary product container that is customarily delivered to a consumer by a vending machine. The vendable prize delivery mechanism has an opening to an interior region for insertion of the premium and allows the consumer to access the premium. Preferably, the vendable prize delivery mechanism is sufficiently transparent so that the consumer can see the premium without opening the mechanism. Generally, the vendable prize delivery mechanism is branded similar to the primary product container to assist in brand awareness.

A carrier to hold the premium may be included with the assembling of the vendable prize delivery mechanism. The carrier optionally can provide the vendable prize delivery mechanism with sufficient rigidity to withstand being placed in a column of primary product containers without degradation of the vendable prize delivery mechanism. Furthermore, the carrier can be weighted a carrier so that the vendable prize delivery mechanism more closely approximates the primary product container filled with a beverage. The carrier can also include weighted interlocking components to hold the premium. One carrier embodiment has the weighted interlocking components comprising a carrier plug shaped to conform to an inner bottom surface of the primary product container.

BRIEF DESCRIPTION OF THE DRAWINGS

Benefits and further features of the present invention will be apparent from a detailed description of preferred embodiment thereof taken in conjunction with the following drawings, wherein like elements are referred to with like reference numbers, and wherein.

DETAILED DESCRIPTION OF THE INVENTION

Utilizing a coin slot, the present invention provides for the vending of a prize or premium with the flexibility to use local market currencies in differing denominations and amounts while reducing labor and transportation costs. In the local markets where the promotions are to be done, the promoting company can determine the appropriate coinage for the nearby vending machines. Thus, flexibility of the promotion for differing locales and for vending machines requiring different coinage is achieved.

Figure 1:
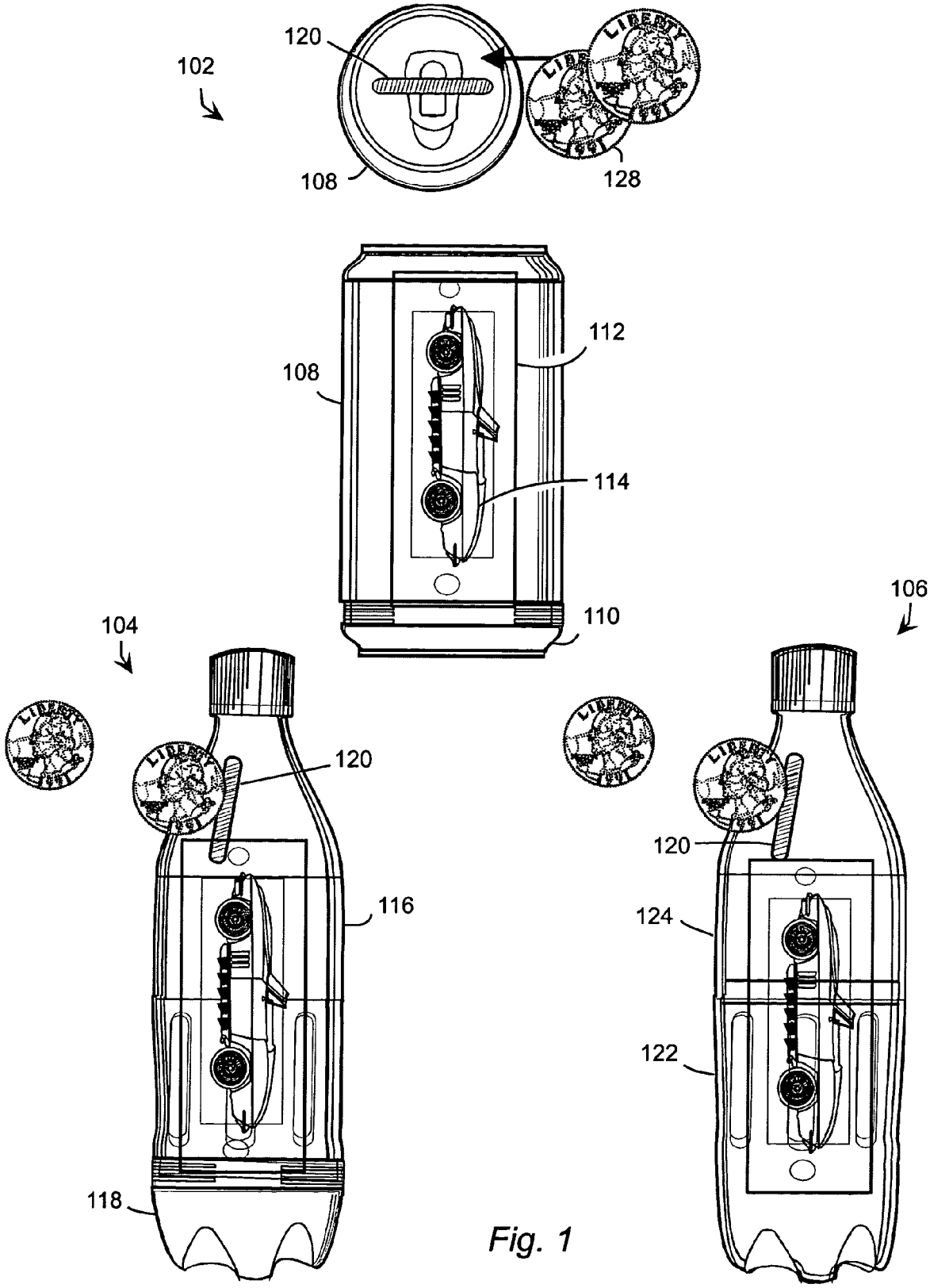
FIG. 1 illustrates embodiments of containers that deliver a premium.

Turning now to figures, in which like numerals indicate like elements throughout the several figures, FIG. 1 illustrates several embodiments of articles of manufacture that are sized and shaped like those of a beverage container that can be vended in a vending machine.

Illustrated, in a top and side view, is a beverage container 102 in the form of a can that is sized and shape similar to those typically dispensed in a vending machine. The can 102 has a top section 108 that can be screwed into a bottom section 110 during an assembly process. The can 102 is the delivery mechanism for a prize or premium 114. Optionally, the premium 114 can be placed in a carrier 112 in order to stabilize the premium inside the can 102 during shipping and handling and to provide additional weight, if required, to enable the can 102 to easily dispense from a vending machine.

The top section 108 of the can container 102 includes a slot 112 into which a number of coins or other currency 128 can be inserted. The number and the denomination of the currency 128 can be determined near the time as at which the prize-filled container is placed into the vending machine. Provision of the currency 128 within the container 102, together with the premium 114, allows the consumer to obtain a beverage from the vending machine in accordance with their original desire, after receiving the prize or promotion 114 from their original funds inserted into the vending machine.

Also illustrated in FIG. 1 is a beverage container 104 in the form a bottle that is sized and shape similar to those typically dispensed in a vending machine. The bottle 104 has a top section 116 that can be screwed into a bottom section 118 during an assembly process. The bottle 104 is likewise the delivery mechanism for a prize or premium 114. Optionally, the premium 114 can be placed in a carrier 112 in order to stabilize the premium inside the bottle 104 during shipping and handling and to provide additional weight, if required, to enable the bottle 104 to easily dispense from a vending machine. Similar to the can embodiment 102, the top section 116 of the bottle container 104 includes a slot 120 into which a number of coins or other currency 128 can be inserted.

Further illustrated in FIG. 1 is another beverage container 106 in the form a bottle that is sized and shape similar to those typically dispensed in a vending machine. The bottle 106 has a top section 124 that can snap onto a bottom section after the insertion of the premium 114. A consumer can snap off the top section 124 to access the prize or promotional material 114. Similar to the screw off bottle embodiment 104, the top section 124 of the snap off bottle container 106 includes a slot 120 into which a number of coins or other currency 128 can be inserted.

Figure 2:
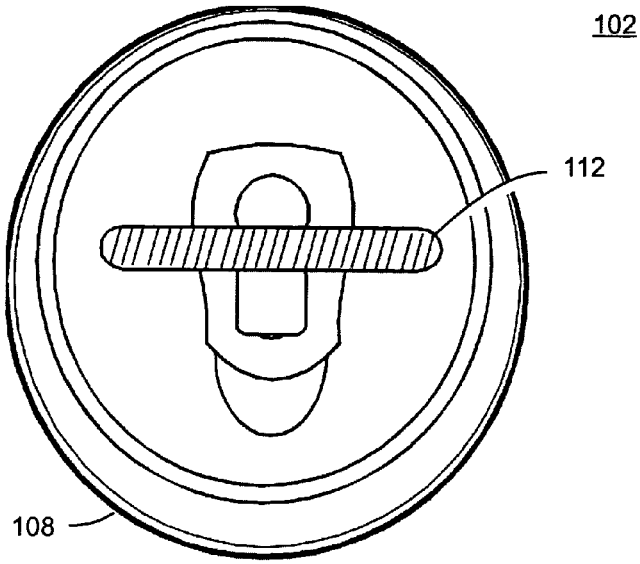
FIG. 2 is a top and side view of a can container.
Figure 2:
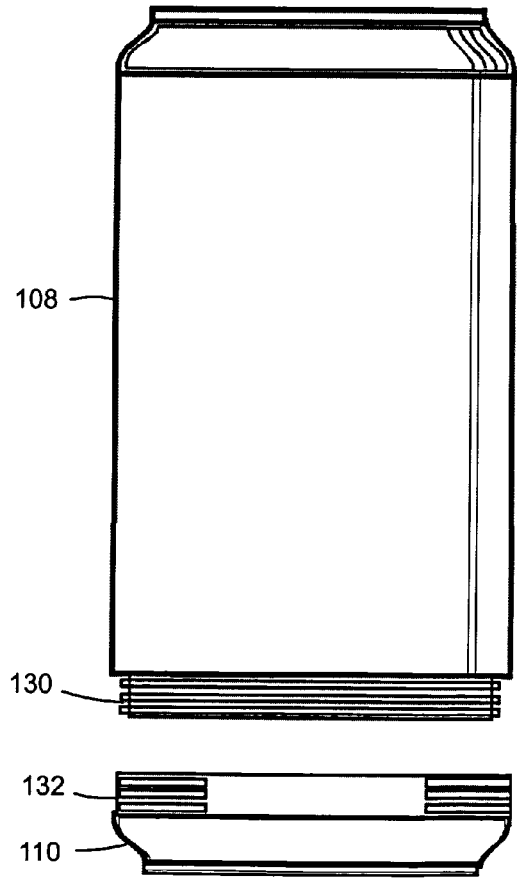

Turning now to FIG. 2, illustrated is the top and side view of the beverage can 102 of FIG. 1. The can 102 includes a top section 108 and a bottom section 110 preferably made out of a transparent material. The bottom of the top section 108 includes a threaded section 130 that can be screwed into a bottom screw receptacle section 132 of the bottom can section 110 during an assembly process. The top section 108 of the can container 102 includes a slot 120 into which a number of coins or other currency can be inserted. The number and the denomination of the currency can be determined near the time at which the prize-filled container is placed into the local market vending machine. Thus, improved design enables local market adaptability of promotional programs that has otherwise been restricted because it has been difficult to change the amount or type of currency needed to purchase the primary product in the local market where the promotion is to be done.

Figure 3:
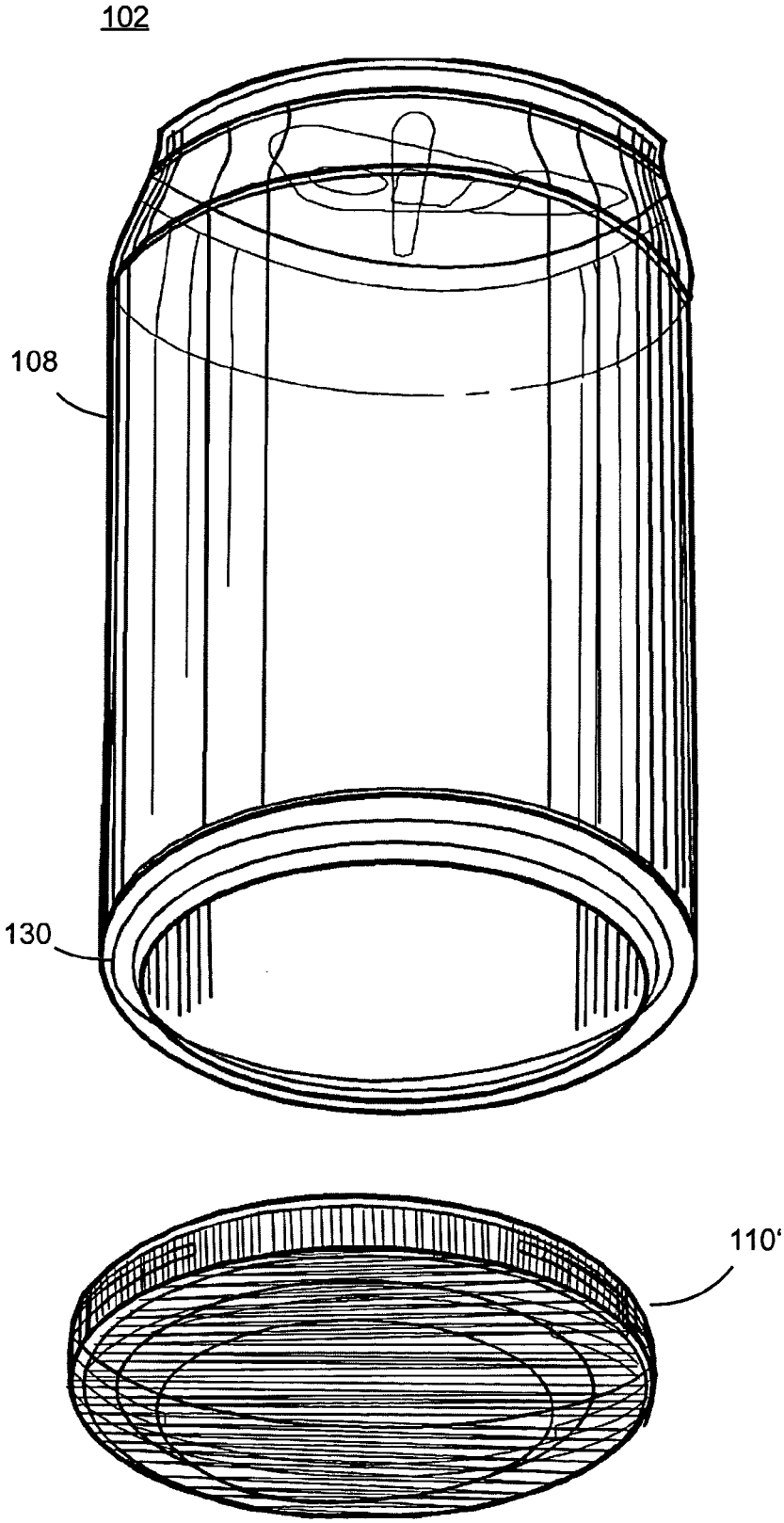
FIG. 3 is a perspective view of a can container with a solid bottom.

Turning to FIG. 3, illustrated is the beverage can 102 of FIG. 1 in perspective, with the bottom section 110' shaded to indicate solid material. In this manner, adequate weighting for the container and premium can be provided by using sufficient quantity of solid material in the bottom section 110'. The threaded section 130 of the top section 108 screws into the bottom section 110' as describe in reference to FIG. 2. Weighting of the bottom section 110' ensures that adequate weight is available to dispense the can container 102 from a vending machine.

Figure 4:
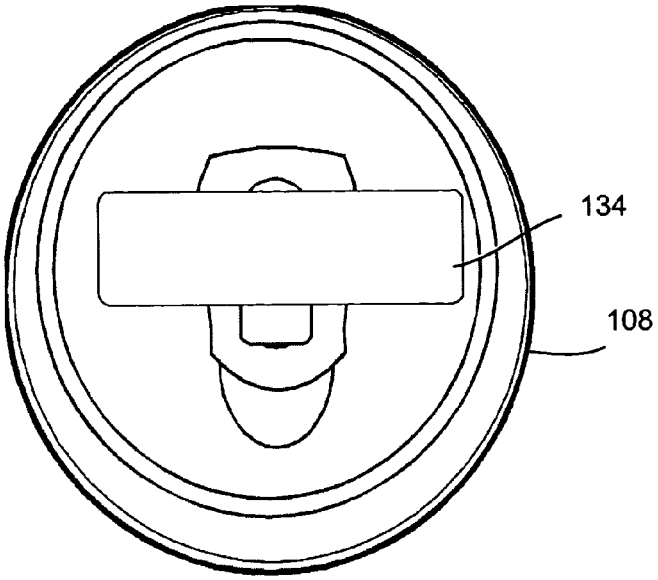
FIG. 4 is a top and side view of a can container holding both a premium and added currency.
Figure 4:
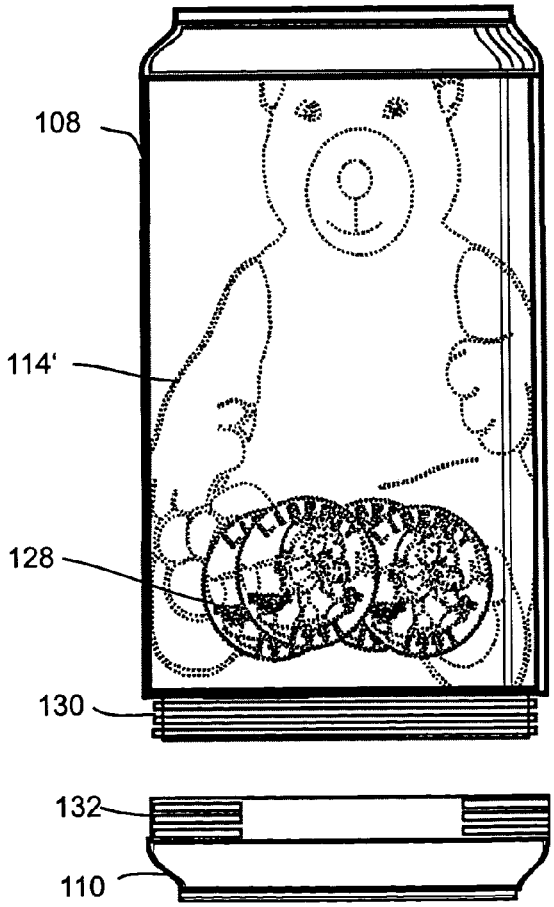

FIG. 4 illustrates the can container 102 of FIG. 1. top and side views, with an exemplary prize or premium 114' therein, a stuffed animal in this example, shown in dotted lines. The premium 114' can be inserted into the top section 108 at a different location than the location of manufacture of the top section 108 and the bottom section 110. After insertion of the premium 114', the threaded section 130 can be easily screwed into the bottom screw receptacle section 132 to form the can container 102.

Also shown is a number of coins 128 representing an amount required to purchase the primary product in the local currency. The currency 128 can be added via the coin slot previously illustrated at a location near the vending machines. Tape 134 or similar flat covering material covers the coin slot. The tape 134 prevents loss of coins during shipping and discourages personnel from shaking the containers to remove the coins 128.

Figure 5:
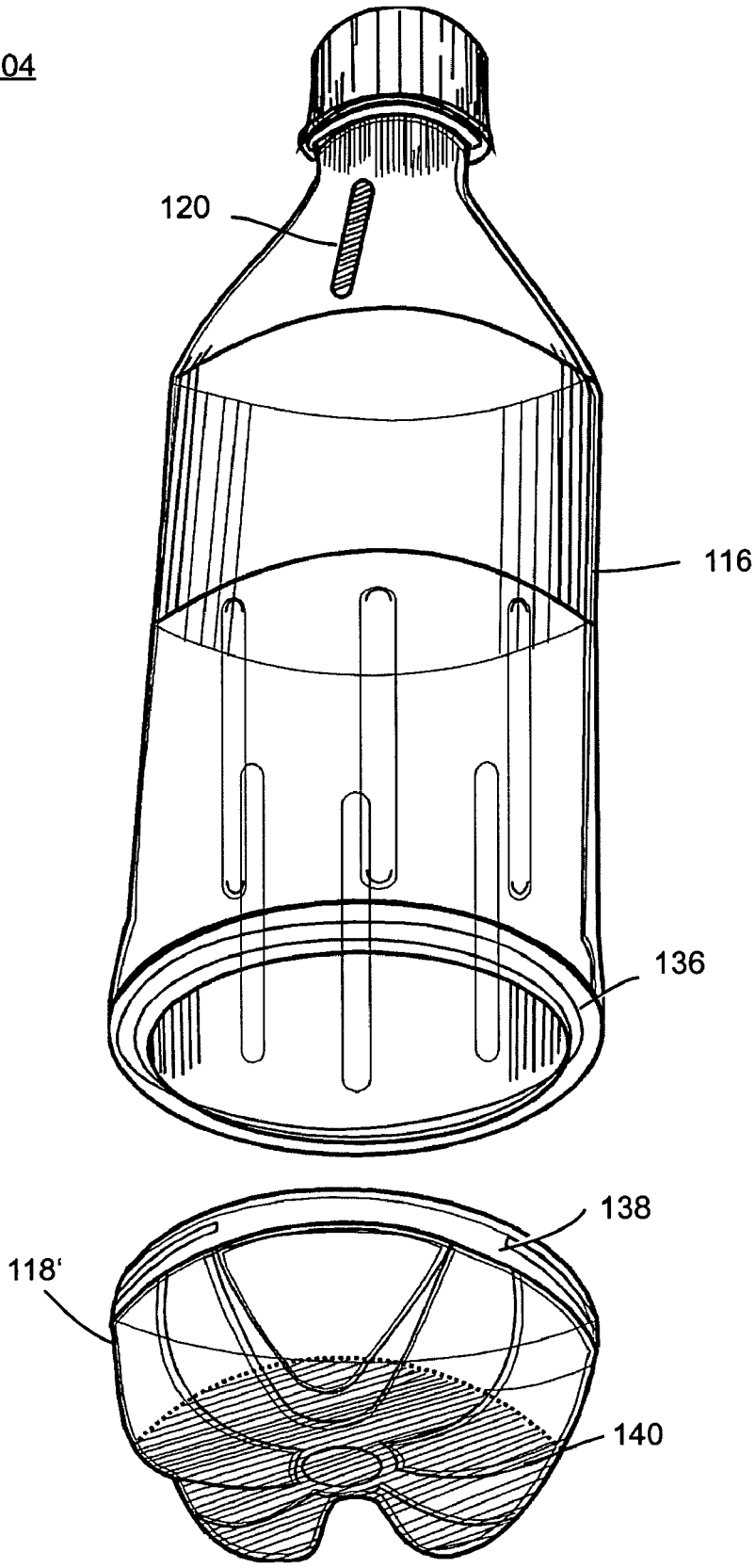
FIG. 5 is a perspective view of a bottle container with a removable weighted bottom.

FIG. 5 illustrates a beverage bottle 104 of FIG. 1 in perspective. Preferable the top section 116 has a threaded section 136. The bottom portion 118' has a screw receptacle section 138 and is removable. The removable bottom section 118' is shaded to indicate solid material used as the bottom 140. In this manner, additional weighting for the container 104 is provided to more closely approach the weight of a bottle full of beverage.

Figure 6:
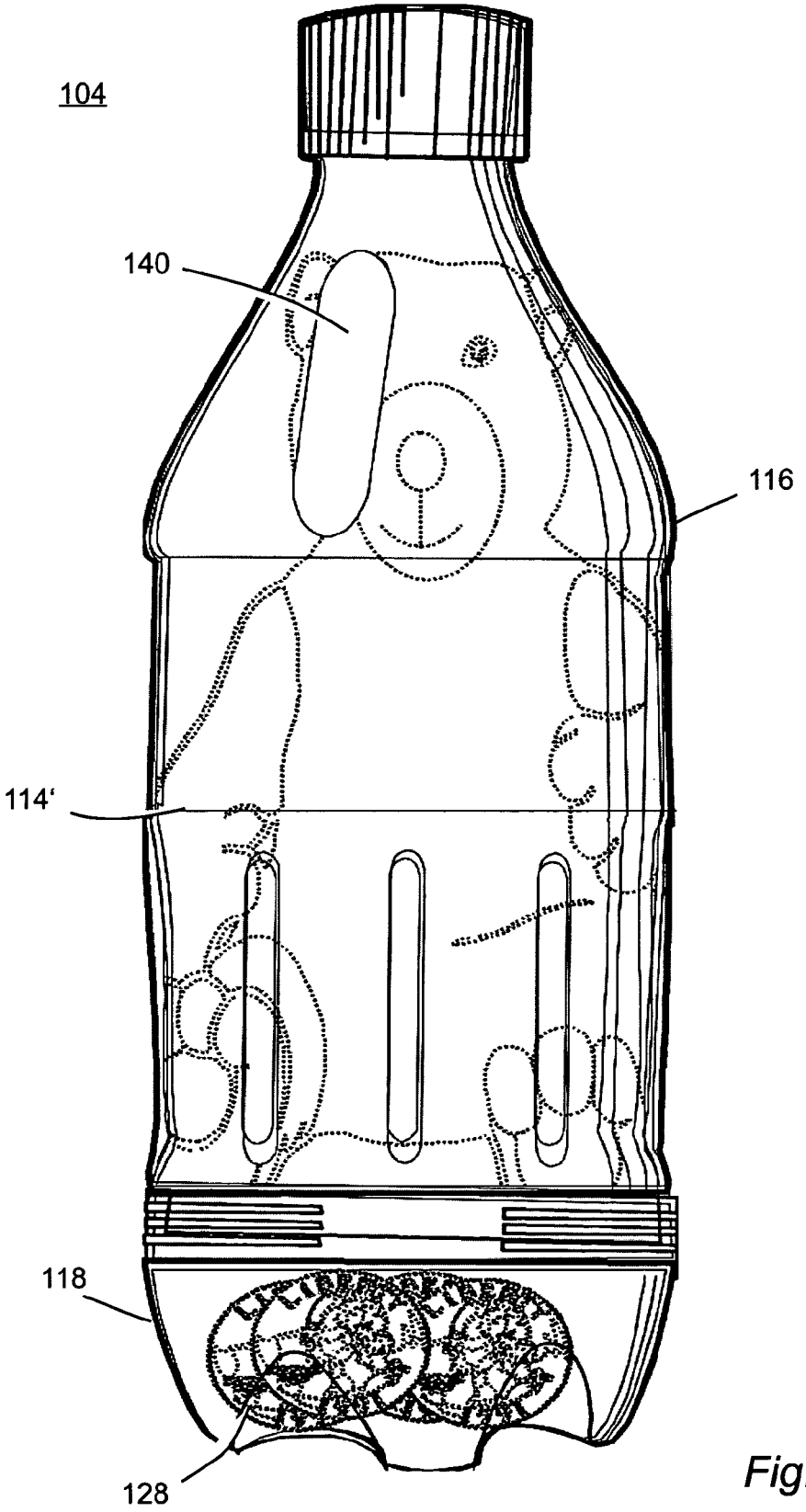
FIG. 6 is a side view of a bottle container holding both a premium and added currency.

FIG. 6 illustrates the beverage bottle 104 of FIG. 1, side view, with an exemplary prize or premium 114' contained therein, shown in dotted lines, with a number of coins 128 contained therein, with a piece of tape 140 or covering material over the coin slot. In place of tape, the whole container 104 can be shrink wrapped to prevent the currency 128 from either inadvertent or deliberate loss of coins.

Figure 7:
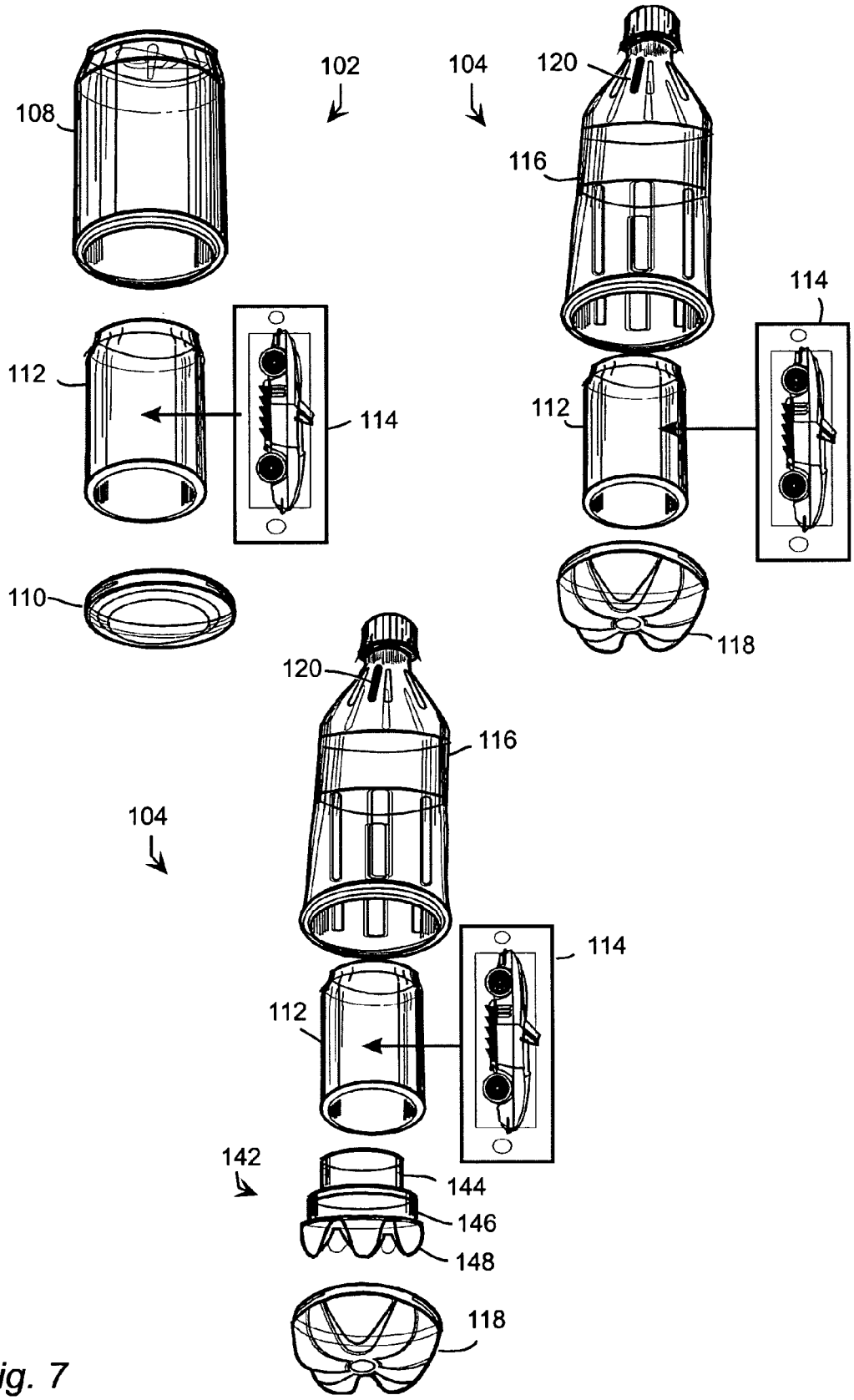
FIG. 7 is a perspective view of containers with carriers to hold the premium.

FIG. 7 illustrates perspective views of embodiments of unassembled containers, sized and shaped like those of beverage containers that can be vended from a vending machine.

The can container 102 of FIG. 1 is illustrated. As shown, the premium 114 is inserted into a carrier 112. The carrier 112 stabilizes the premium 114 during transportation and handling. The carrier also adds additional weight so that assembled container 102 approaches the weight of a can container filled with beverage. After insertion of the carrier 112 with the premium 114 inside, the bottom section 110 can be screwed onto the top section 108. The can container 102 is now ready to be shipped to various localities for the addition of local currency before being placed inside a vending machine.

Also, the bottle container 104 of FIG.1 is illustrated. As shown, the premium 114 is inserted into a carrier 112. The carrier 112 stabilizes the premium 114 during transportation and handling. The carrier also adds additional weight so that the assembled container 104 approaches the weight of a can container filled with a beverage. After insertion of the carrier 112 with the premium 114 inside, the bottom section 118 can be screwed onto the top section 116. The bottle container 104 is now ready to be shipped to various localities for the addition of local currency before being placed inside a vending machine.

Additionally, another embodiment of the bottle container 104 of FIG. 1 is illustrated. As shown, the premium 114 is inserted into a carrier 112. The carrier 112 stabilizes the premium 114 during transportation and handling. Preferably, a carrier plug 142 firmly holds the carrier in place. The carrier plug 142 has a top section 144 with an outside diameter that snugly fits into the bottom opening of the carrier 112. The carrier 112 rests on the middle section 146 of the carrier plug 142. The bottom of the carrier plug 148 is molded to conform the shape of a beverage bottle and fit snugly therein. The carrier also adds additional weight so that assembled container 104 approaches the weight of a can container filled with beverage. After insertion of the carrier 112 with the premium 114 inside, the bottom section 118 can be screwed onto the top section 116. The bottle container 104 is now ready to be shipped to various localities for the addition of local currency before being placed inside a vending machine.

Figure 8:
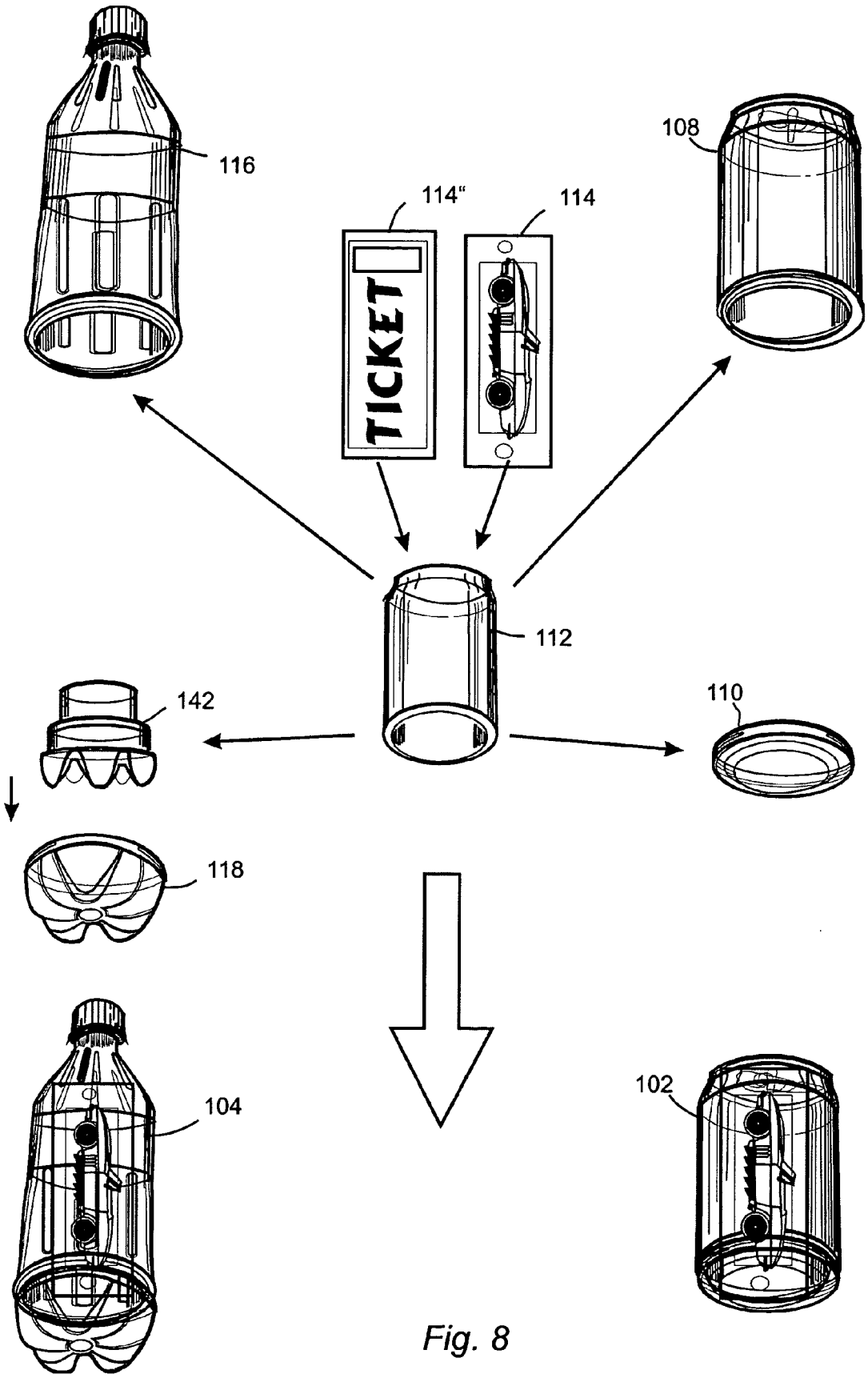
FIG. 8 illustrates a process to assemble the containers.

FIG. 8 illustrates the assembly process for premiums placed into containers that can be vended from a vending machine. Premiums such as tickets 114", collectibles 114, or promotional materials 114' are inserted into a carrier 112. Then the carrier is inserted into either a bottle top 116 or a can top 108. Preferably, for bottle containers 104, a carrier plug is inserted into the carrier before screwing on the bottle bottom 142. After insertion of the carrier 112, a bottom can 110 section is screwed onto the top can section 108, or a bottom bottle section 118 is screwed onto the top bottle section 116. This assembly process, if done manually, can be performed in a location where labor costs are relatively cheap.

Figure 9:
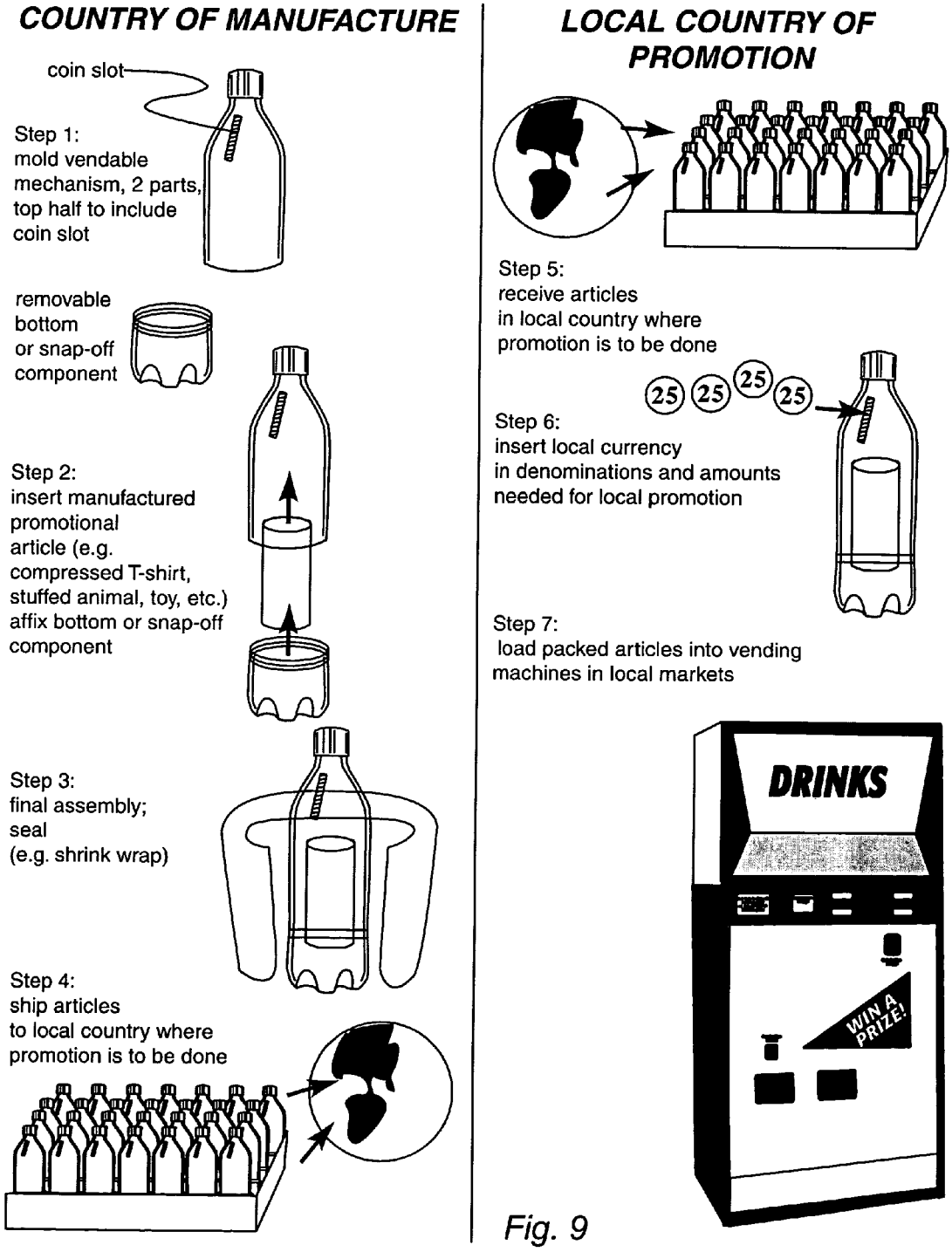
FIG. 9 illustrates a process for vending premiums at reduced labor costs and adapted to local currency.

FIG. 9 illustrates the steps for the process for vending promotional articles with reduced labor costs and adapted for local currency. In step 1, the vendable articles are molded. The articles consist of a top section and a removable bottom section. Step 2 follows step 1, in which the promotional items are inserted. This step can be performed at the location of step 1 or at another location where labor costs are cheap. Step 3 follows step 2, in which the articles are sealed, typically by shrink-wrap. Step 4 follows step 3, in which the articles are shipped to multiple locations near where the articles are to be vended. Step 5 follows step 4, in which the articles are received at the locale in which the promotion is being done. Step 6 follows step 5, in which the currency is added that is appropriate for the particular locale. The slot is preferably sealed by tape or by shrink-wrap of the article. Step 7 concludes the process whereby the articles are loaded in vending machines for sale to consumers.

In view of the foregoing, it will be appreciated that the invention delivers a premium via a vending machine that can save significant labor and transportation costs and which allows for the later insertion of local currencies in the denominations and amounts required in the country in which the promotion is being done (which typically differs from the country in which the premium was manufactured). It should be understood that the foregoing relates only to the exemplary embodiments of the present invention, and that numerous changes may be made therein without departing from the spirit and scope of the invention as defined by the following claims. Accordingly, it is the claims set forth below, and not merely the foregoing illustrations, which are intended to define the exclusive rights of the invention.

The invention claimed:

1. A vendable delivery article, comprising:

a vendable prize delivery mechanism with a currency slot for the insertion of local market currency where the promotion is being done;

the vendable prize delivery mechanism of a size and shape like that of a primary product container that is customarily delivered to a consumer by a vending machine, having an opening to an interior for receiving a premium; and a removable section to allow insertion of the premium into the interior of the article.

2. The vendable delivery article of claim 1, wherein the vendable prize delivery mechanism resembles a beverage can.

3. The vendable delivery article of claim 1, wherein the vendable prize delivery mechanism resembles a beverage bottle.

4. The vendable delivery article of claim 1, wherein the removable section comprises a weighted removable bottom section.

5. The vendable delivery article of claim 1, further comprising material covering the currency slot.

6. The vendable delivery article of claim 1, wherein the premium can be accessed by unscrewing the removable section.

7. The vendable delivery article of claim 1, wherein the premium can be accessed by snapping apart the removable section.

8. The vendable delivery article of claim 1, wherein the vendable prize delivery mechanism is sufficiently transparent so that the consumer can see the premium without opening the removable section.

9. The vendable delivery article of claim 1, wherein the vendable prize delivery mechanism is branded similar to the primary product container.

10. The vendable delivery article of claim 1, further comprising a carrier that provides the vendable prize delivery mechanism with sufficient rigidity to withstand being placed in a column of primary product containers without degradation of the delivery mechanism.

11. The vendable delivery article of claim 1, further comprising a weighted carrier to encapsulate the premium.

12. The vendable delivery article of claim 1, further comprising weighted interlocking components to hold the premium.

13. The vendable delivery article of claim 12, wherein the weighted interlocking components comprise a carrier plug shaped to conform to an inner bottom surface of the primary product container.

14. A method for delivering a vendable delivery article via a vending machine, comprising the steps of:

manufacturing a vendable prize delivery mechanism with an open currency slot;

assembling the vendable prize delivery mechanism by placing the premium into an interior region of the vendable prize mechanism;

shipping the vendable prize delivery mechanism to multiple locations near where the vendable prize delivery mechanisms are to be vended;

inserting into the currency slot a proper local currency in the type and amount dictated by the local specific primary product cost into the vendable prize delivery mechanism; and placing the local vendable prize delivery mechanism into a local vending machine.

15. The method of claim 14, wherein the vendable prize delivery mechanism resembles a beverage can.

16. The method of claim 14, wherein the vendable prize delivery mechanism resembles a beverage bottle.

17. The method of claim 14, wherein the vendable prize delivery mechanism comprises a weighted bottom section.

18. The method of claim 14, further comprising the step of covering the currency slot.

19. The method of claim 14, wherein the premium can be accessed by unscrewing a removable section.

20. The method of claim 14, wherein the premium can be accessed by snapping apart a removable section.

21. The method of claim 14, wherein the vendable prize delivery mechanism is sufficiently transparent so that the consumer can see the premium without opening a removable section.

22. The method of claim 14, wherein the vendable prize delivery mechanism is branded similar to a primary product container customarily vended by the local vending machine.

23. The method of claim 14, wherein the vendable prize delivery mechanism has sufficient rigidity to withstand being placed in a column of primary product containers without degradation of the vendable prize delivery mechanism.

24. The method of claim 14, further comprising inserting a weighted carrier that holds the premium into the vendable prize delivery mechanism.

25. The method of claim 14, further comprising inserting into the vendable prize delivery mechanism weighted interlocking components to hold the premium.

26. The method of claim 25, wherein the weighted interlocking components comprise a carrier plug shaped to conform to an inner bottom surface.

27. The method of claim 14, further comprising the step of sealing the mechanism by shrink-wrapping prior to shipping.

28. The method of claim 27, further comprising the step of covering the currency slot.

29. A method for delivering a vendable prize delivery article including a premium from a vending machine that requires a local currency, comprising the steps of:

(a) inserting the premium into the vendable prize delivery article at a first location removed from the location of the vending machine, the vendable prize delivery article including a currency slot for receiving local currency for use in a vending machine;

(b) inserting local currency into the vendable prize delivery article at a second location where a local currency is applicable for a vending machine; and (c) placing the vendable prize delivery article including the premium and inserted local currency into the vending machine.

30. The method of claim 29, wherein the vendable prize delivery article resembles a beverage can.

31. The method of claim 29, wherein the vendable prize delivery article resembles a beverage bottle.

32. The method of claim 29, wherein the vendable prize delivery article comprises a weighted bottom section.

33. The method of claim 29, further comprising the step of covering the currency slot.

34. The method of claim 29, wherein the premium can be accessed by unscrewing a removable section.

35. The method of claim 29, wherein the premium can be accessed by snapping apart a removable section.

36. The method of claim 29, wherein the vendable prize delivery article is sufficiently transparent so that the consumer can see the premium without opening a removable section.

37. The method of claim 29, wherein the vendable prize delivery article is branded similar to a primary product container customarily vended by the local vending machine.

38. The method of claim 29, wherein the vendable prize delivery article has sufficient rigidity to withstand being placed in a column of primary product containers without degradation of the vendable prize delivery article.

39. The method of claim 29, further comprising inserting a weighted carrier that holds the premium into the vendable prize delivery article.

40. The method of claim 29, further comprising inserting into the vendable prize delivery article weighted interlocking components to hold the premium.

41. The method of claim 40, wherein the weighted interlocking components comprise a carrier plug shaped to conform to an inner bottom surface.

42. The method of claim 29, further comprising the step of sealing the article by shrink-wrapping prior to shipping.

43. The method of claim 42, further comprising the step of covering the currency slot.

44. The method of claim 29, further comprising the step of shipping the article including the premium to a second location where a promotion involving the premium is done.

45. The method of claim 44, further comprising the step of shipping the article including the premium to multiple locations near where the articles are to be vended.

46. The method of claim 14, wherein the step of shipping the vendable prize delivery mechanism to multiple locations comprises shipping a plurality of articles to a local country where the promotion is being done.

* * * * *